US005195681A

United States Patent [19]

Chyen

[11] Patent Number: 5,195,681

[45] Date of Patent: Mar. 23, 1993

[54] FAUCET FOR SELECTIVELY DISCHARGING DOWNWARD OR UPWARD WATER STREAM

[76] Inventor: Jen T. Chyen, c/o Hung Hsing Patent Service Center P.O. Box 55-1670, Taipei (10477), Taiwan

[21] Appl. No.: 815,151

[22] Filed: Dec. 31, 1991

[51] Int. Cl.[5] ..... E03B 9/20

[52] U.S. Cl. ..... 239/25; 4/678

[58] Field of Search ..... 4/620, 638; 239/24, 239/25, 27; 137/887

[56] References Cited

U.S. PATENT DOCUMENTS

| | | | |
|---|---|---|---|
| 2,068,794 | 1/1937 | Gavriles | 239/25 |
| 2,171,471 | 8/1939 | Brunetti | 239/25 |
| 2,860,348 | 11/1958 | McClenahan | 4/DIG. 15 |
| 3,101,174 | 8/1963 | Loveland | 239/27 |
| 3,208,477 | 9/1965 | Gabriel | 239/24 X |
| 3,371,868 | 3/1968 | Abbott | 239/27 |
| 4,934,597 | 6/1990 | Crutcher | 239/27 |
| 4,982,460 | 1/1991 | Tobias et al. | 4/541 X |

*Primary Examiner*—Charles E. Phillips

[57] ABSTRACT

A faucet includes an inner tube inserted in an upper opening formed in between a horizontal spout portion of the faucet and a downcomer spout portion having a lower tube hole of the inner tube poked into the downcomer spout portion and positioned under an overflow level of the horizontal spout portion, whereby upon a shielding or closing of a discharge outlet formed in a lowermost end of the downcomer spout portion, a water stream, as supplied by an opened faucet, will be ejected upwardly through the inner tube for rinsing or drinking purpose.

1 Claim, 1 Drawing Sheet

FAUCET FOR SELECTIVELY DISCHARGING DOWNWARD OR UPWARD WATER STREAM

BACKGROUND OF THE INVENTION

L. J Hulla disclosed a faucet in his U.S. Pat. No. 1,504,623 including an outlet nose piece (23) rotatably mounted on a tubular outlet conduit (13) of the faucet, in that a projection or handle (31) may be held for rotating the nose piece (23) upwardly for spraying water upwardly for drinking or other purposes.

However, such a conventional faucet may have the following drawbacks:

1. For providing an upwardly flowing water, the nose piece 23 should be rotated upwardly for a user's drinking or for rinsing his (her) mouth. Then, the nose piece 23 should be rotated downwardly for discharging a downward water stream for washing a user's hands or other uses. Therefore, it is still inconvenient for turning the nose piece either upwardly or downwardly.

2. A water leakage may be caused at the coupling joint such as between the outer flange (25) and the inner flange (24), thereby increasing maintenance problem.

3. If for rinsing purpose by rotating the nose piece 23 upwardly for discharging an upward water stream for cleaning a user's face, for example, an outlet of the water conduit, having a same opening size for either an upward or a downward water flow, may not eject a water stream with high pressure, unless by partially shielding the outlet of nose piece for reducing its opening size or by increasing the boosting pressure of a water supply source. Such an upward water stream with low pressure may not be ejected so high to possibly influence a rinsing efficiency for the user.

The present inventor has found the drawbacks of a conventional faucet and invented the present faucet for discharging water stream either upwardly or downwardly.

SUMMARY OF THE INVENTION

The object of the present invention is to provide a faucet including an inner tube inserted in an upper opening formed in between a horizontal spout portion of the faucet and a downcomer spout portion having a lower tube hole of the inner tube poked into the downcomer spout portion and positioned under an overflow level of the horizontal spout portion, whereby upon a shielding or closing of a discharge outlet formed in a lowermost end of the downcomer spout portion, a water stream, as supplied by an opened faucet, will be ejected upwardly through the inner tube for rinsing or drinking purpose.

DETAILED DESCRIPTION

Figure 1:
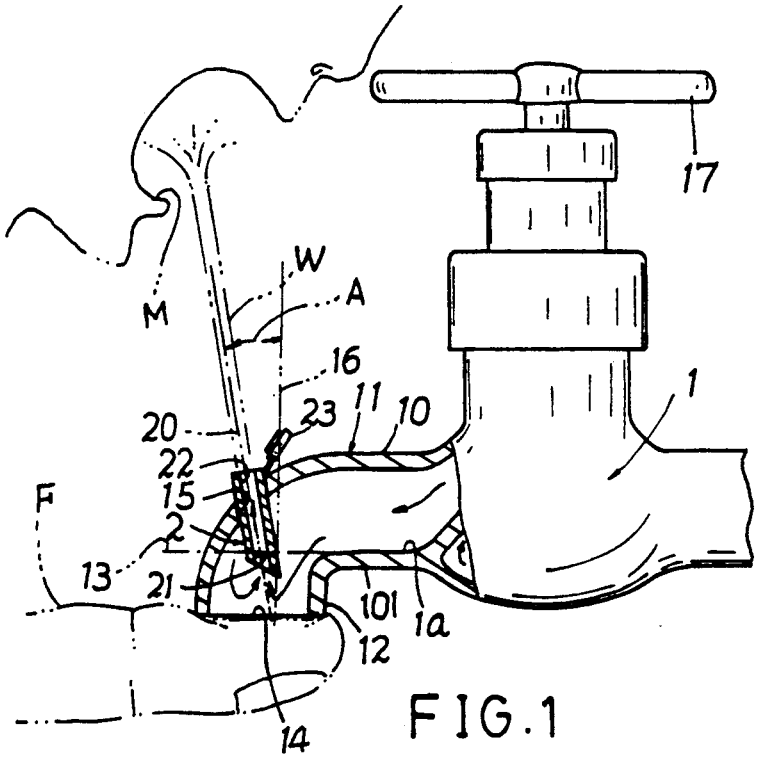
FIG. 1 is an illustration showing an upward water ejection in accordance with the present invention.
Figure 2:
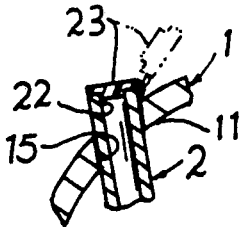
FIG. 2 is a partial sectional drawing of the inner tube of the present invention.

As shown in FIGS. 1, 2, a faucet of the present invention comprises: a valve body 1 having a spout 11 inserted with an inner tube 2 in the spout 11.

The valve body 1 includes: a spout 11 having a horizontal spout portion 10 connected with a water outcoming port 1*a* of the valve body 1, a downcomer spout portion 12 bent downwardly from and connected with the horizontal spout portion 10, an overflow level 13 horizontally tangential to a bottom wall surface of the horizontal spout portion 10 and generally perpendicular to a longitudinal axis 16 longitudinally formed in a center line of the downcomer spout portion 12, a discharge outlet 14 formed in a lowermost end of the downcomer spout portion 12, an upper opening 15 formed in a deflection portion between the horizontal spout portion 10 and the downcomer spout portion 12, and a valve handle 17 rotatably mounted on the valve body for opening or closing the faucet.

The inner tube 2 having an outside diameter smaller than an inside diameter of the spout 11 is inserted into the spout 11 through the upper opening 15 of the spout 11 to deeply poke into the downcomer spout portion 12 with a lower tube hole 21 formed on a lower end of the inner tube 2 positioned below the overflow level 13 of the spout 11 and oriented downwardly towards the discharge outlet 14, and with an upper tube hole 22 formed on an upper end of the inner tube 2 adjacent to the upper opening 15 of the spout 11.

Upon an opening of the faucet and a shielding or closing on the discharge outlet 14 of the spout 11 by an external body such as a user's finger F as shown in FIG. 1, the water stream W will enter the inner tube 2 through the lower tube hole 21 and be ejected upwardly through the upper tube hole 22 for rinsing or drinking purpose such as for spraying into a user's mouth M.

The inner tube 2 may be provided with a cap 23 removably sealing the upper tube hole 22 of the inner tube 2 for preventing contamination of the faucet or for well preventing a water leakage from the faucet.

The inner tube 2 defines a tube axis 20 longitudinally formed in a center line of the inner tube 2 forming a tilting acute angle A between the tube axis 20 and the longitudinal axis 16 of the downcomer spout portion 12 which is preferably formed as a vertical spout portion. By the way, the upward ejecting water stream may be inclinedly sprayed into a user's mouth for using the water efficiently and more ergonomically. The lower tube hole 21 of the inner tube 2 is formed with a sloping opening tapered downwardly rightwardly to be oriented in a direction opposite to a water inlet leftward direction from the incoming water source.

The present invention is superior to a conventional faucet with the following advantages:

1. The faucet can be used for selectively spraying a water stream downwardly or upwardly very conveniently.

2. There is less maintenance problem, such as for repairing water leakage of the faucet, in accordance with the present invention.

3. The inner tube is smaller in diameter than the spout 11 of the faucet so that an upwardly spraying water stream may get a greater water pressure for an efficient rinsing purpose.

The lower tube hole 21 of the inner tube 2 is positioned below the overflow level 13 of the spout 11 and a plane containing the hole 21 being oriented downwardly towards the discharge outlet 14 in order to ensure a downward flowing of a water stream through the downcomer spout portion 12 when the discharge outlet 14 is normally opened. So, in a normal downward water flow through the outlet 14, the water stream will not backflow or uprise through the inner tube 2, preventing forming a by-pass flow through the upper tube hole 22 of the inner tube 2.

I claim:

1. A faucet comprising: a valve body including: a spout having a horizontal spout portion connected with a water outcoming port of the valve body, a generally vertically oriented downcomer spout portion bent downwardly from and connected with the horizontal spout portion, an overflow level horizontally tangential to a bottom wall surface of the horizontal spout portion and generally perpendicular to a longitudinal axis longitudinally formed on a center line of the downcomer spout portion, a discharge outlet formed in a lowermost end of the downcomer spout portion, an upper opening formed in a deflection portion between the horizontal spout portion and the downcomer spout portion, and a valve handle rotatably mounted on the valve body for opening or closing the faucet, and an inner tube having an upper tube hole formed in an upper end thereof the inner tube upper and extending above the upper opening of the spout when the inner tube is inserted into the upper opening and affixed to the deflector portion, the inner tube having an outside diameter smaller than an inside diameter of the spout, the improvement which comprises said inner tube deeply poking into the downcomer spout portion with a lower tube hole formed on a lower end of the inner tube, the hole being positioned below the overflow level of the spout and a plane containing the hole being oriented downwardly towards the discharge outlet, said inner tube defining a tube axis longitudinally formed on a center line of the inner tube forming an acute angle, tilting away from the valve body, between the tube axis and the longitudinal axis of the downcomer spout portion, whereby upon an opening of the faucet and a shielding or closing of the discharge outlet of the spout by an external body, a water stream will enter the inner tube through the lower tube hole of the inner tube and be ejected upwardly through the upper tube hole of the inner tube for rinsing or drinking purpose and when the opening is not closed water will flow therethrough without uprising through the inner tube.

* * * * *